US007228661B2

(12) United States Patent
Rizzotto

(10) Patent No.: US 7,228,661 B2
(45) Date of Patent: Jun. 12, 2007

(54) RAPID STEEL FRAME ASSEMBLY

(76) Inventor: John L. Rizzotto, 4921 SE. Pompano Ter., Stuart, FL (US) 34997

( * ) Notice: Subject to any disclaimer, the term of this patent is extended or adjusted under 35 U.S.C. 154(b) by 367 days.

(21) Appl. No.: 10/411,648

(22) Filed: Apr. 11, 2003

(65) Prior Publication Data

US 2003/0230039 A1 Dec. 18, 2003

Related U.S. Application Data

(63) Continuation-in-part of application No. 10/095,764, filed on Mar. 13, 2002, now Pat. No. 6,679,023.

(60) Provisional application No. 60/315,172, filed on Aug. 28, 2001, provisional application No. 60/276,623, filed on Mar. 19, 2001.

(51) Int. Cl.
*E02D 27/42* (2006.01)
*E02D 27/32* (2006.01)

(52) U.S. Cl. ..... 52/170; 52/155; 52/165; 52/295; 52/296; 52/297

(58) Field of Classification Search ..... 52/292–299, 52/169.9, DIG. 11, 155, 156, 165, 169.13, 52/170, 698, 712–715, 699–700, 740.1, 740.6–740.7
See application file for complete search history.

(56) References Cited

U.S. PATENT DOCUMENTS 1,705,742 A * 3/1929 Werner ..... 52/149
2,815,656 A * 12/1957 Klein et al. ..... 52/169.1
3,555,751 A * 1/1971 Thorgusen ..... 52/127.3
3,662,502 A 5/1972 Wright ..... 52/650
3,771,273 A * 11/1973 Brodie ..... 52/646
4,342,177 A 8/1982 Smith ..... 52/93
4,365,451 A * 12/1982 Nelson ..... 52/169.9
4,435,940 A 3/1984 Davenport et al. ..... 52/90
4,627,205 A * 12/1986 Hitchins ..... 52/294
4,716,696 A * 1/1988 Yacoboni ..... 52/169.9
4,914,875 A * 4/1990 Gustafson ..... 52/126.6
5,217,326 A * 6/1993 Bullivant ..... 405/233
5,218,805 A * 6/1993 Rex ..... 52/295
5,459,967 A 10/1995 Bodtker ..... 52/92.1
5,503,493 A 4/1996 Kato et al. ..... 52/655.1
5,505,033 A * 4/1996 Matsuo et al. ..... 52/296
5,509,237 A * 4/1996 Coulter ..... 52/126.6
5,515,655 A * 5/1996 Hoffmann ..... 52/126.6

(Continued)

OTHER PUBLICATIONS

International Search Report isseud Jul. 29, 2005.

*Primary Examiner*—Jeanette E. Chapman
(74) *Attorney, Agent, or Firm*—Dickstein, Shapiro, LLP.

(57) ABSTRACT

A framing assembly system for steel building that substantially reduces assembly time while maintaining excellent strength and mechanical integrity and has vastly improved resistance to uplift forces. Foundation assemblies or anchor structures are first precisely located before concrete is poured to form the foundation, encasing the anchor structures within the foundation. Columns may then be attached to the anchor structures without the need for readjusting the location of the columns. The rest of the building framework is subsequently attached to the columns. The resulting structure is highly resistant to uplift forces and seismic effects while being much faster and simpler to assemble than previous structures. Cracking of the concrete foundation prior to the complete curing of the concrete is also reduced.

5 Claims, 13 Drawing Sheets

U.S. PATENT DOCUMENTS 5,573,227 A 11/1996 Hemauer ..... 256/65
5,577,353 A 11/1996 Simpson ..... 52/92.2
5,651,635 A * 7/1997 Nagle ..... 404/6
5,664,389 A * 9/1997 Williams ..... 52/677
5,678,382 A * 10/1997 Naito ..... 52/745.21
5,689,927 A * 11/1997 Knight, Sr. ..... 52/297
5,867,963 A 2/1999 Hershey ..... 52/693
5,950,374 A 9/1999 Gromat ..... 52/93.2
5,966,882 A * 10/1999 Naito ..... 52/295
5,979,119 A 11/1999 Trafton ..... 52/40
6,003,280 A 12/1999 Wells ..... 52/653.1
6,038,823 A * 3/2000 Gallimore et al. ..... 52/126.1
6,178,710 B1 * 1/2001 Colalillo ..... 52/310
6,193,442 B1 * 2/2001 May ..... 405/232
6,254,306 B1 7/2001 Williams ..... 52/93.1
6,256,940 B1 * 7/2001 MacKarvich ..... 52/126.6
6,279,273 B1 * 8/2001 Shingaki ..... 52/101
6,279,289 B1 8/2001 Soder et al. ..... 52/653.1
6,347,489 B1 * 2/2002 Marshall et al. ..... 52/169.9
6,352,390 B1 * 3/2002 Jones ..... 405/230
6,397,536 B1 * 6/2002 Morello ..... 52/274
6,438,904 B1 * 8/2002 Anzai et al. ..... 52/167.1
6,536,170 B2 * 3/2003 Stuever ..... 52/299
6,539,685 B2 * 4/2003 Bell et al. ..... 52/741.15
6,550,199 B2 * 4/2003 Phillips ..... 52/294
6,655,875 B1 * 12/2003 Pignato ..... 405/221
6,679,023 B2 * 1/2004 Rizzotto ..... 52/653.2

* cited by examiner

RAPID STEEL FRAME ASSEMBLY

This application is a continuation-in-part of U.S. patent application Ser. No. 10/095,764, filed on Mar. 13, 2002 now U.S. Pat. No. 6,679,023, which claims priority to U.S. Provisional Application Nos. 60/315,172, filed on Aug. 28, 2001, and 60/276,623, filed on Mar. 19, 2001, herein incorporated by reference.

FIELD OF THE INVENTION

The present invention relates to steel frame buildings and more particularly to such buildings that are designed to facilitate the precise location of the column which results in rapid, low cost building assembly without the need for cutting, redrilling or welding of any of the structural members. The present invention also relates to steel frame buildings that are greatly resistant to uplift forces and seismic effects, and a method of constructing the same.

BACKGROUND

There are a number of prior art steel buildings containing features designed to facilitate the assembly of these buildings as evidence by the patents reference below.

U.S. Pat. No. 4,342,177 illustrates a steel frame building in which the roof beams are connected to the columns by means of a plate using bolts. However, this attachment does not allow for height adjustment. The columns are C-shaped and cannot be easily slipped over a foundation assembly.

U.S. Pat. No. 5,577,353 illustrates a steel frame building in which the components of the trusses are held together with pre-drilled truss plates and bolts and the trusses are attached to the columns by means of pre-drilled plates and bolts. However, there is no provision for height adjustment at the column attachment. There is no provision to allow the trusses to be conveniently broken in two for transport and there is no provision to allow the columns to slip over the foundation members.

U.S. Pat. No. 5,979,119 illustrates an assembly of structural building components designed to be attached to a column. The attachment method permits the adjustment of the angle at which beams are connected however, height adjustment is achieved by clamping rather than positive bolting.

In prior art structures, the mounting system for columns was typically bolts placed in the concrete footer before the concrete had set. This is shown in FIG. 12, where a column 31A is connected to a flange 32A. The flange is secured to a footer 35 by means of bolts 34. The position of the bolts is usually determined by a steel tape measure, which usually results in location errors in the order of ¼ to ½ inch. These errors require the framing members to be cut and fitted on the site, a slow and costly process. The reason for these errors are many and include the use of a tape measure, the use of aggregate in the concrete which makes it difficult to precisely set a bolt in place and the fact that the bolt is let stand while the concrete sets up. During the set up process, the bolt can be moved by a variety of forces including the bolt's own weight, pent up pressure points created by forcing the bolt into the concrete, wind, rain and inadvertent contact by workmen.

In the prior art assembly procedure, once the concrete has set up and the bolts have been secured in the concrete, the next task is the lifting of the column over and onto these bolts. The column typically has a lower flange with holes used to accommodate the bolts and connect the column to the footing. The column with its flange is lowered down on to the bolts and nuts are used to secure the bolts to the flange. However, at this time, with the column suspended in the air, it is difficult to correct for the horizontal plane location errors of the bolts, while at the same time connect the column to the bolts and erect the column in a perfectly vertical position. This prior art assembly procedure does not lend itself to precisely locating the column and results in building members not fitting together and requiring time consuming and costly redrilling and cutting on the job site to complete the assembly of the building.

All of the above mentioned disadvantages of the prior art are addressed and overcome in the present invention which is described below.

SUMMARY OF THE INVENTION

Figure 1:
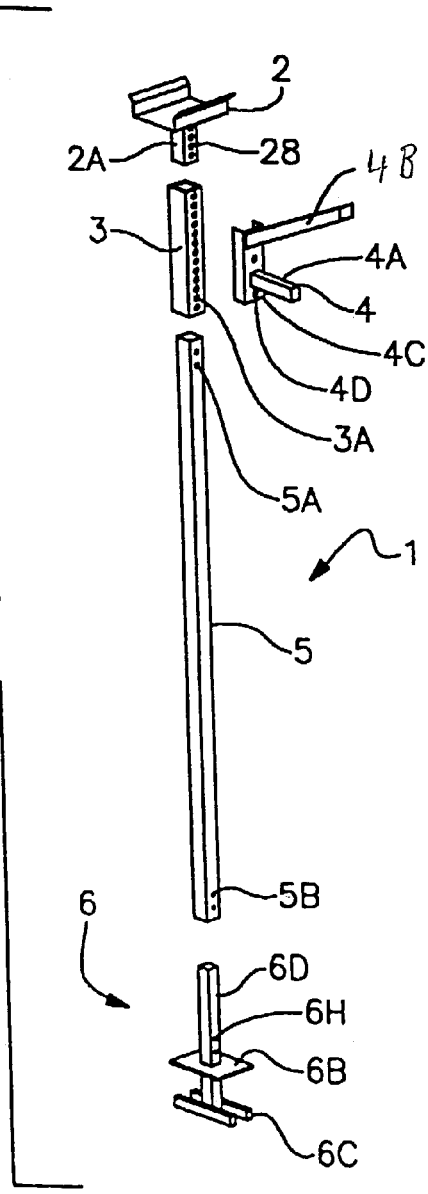
FIG. 1 is an exploded view showing a column used in the assembly of a steel building. This Figure also shows the gutter, truss and foundation assemblies used in conjunction with the column.

It is an object of the present invention to use precisely located foundation assemblies to quickly, easily and accurately locate the building columns in both the horizontal and vertical planes.

It is an object of the present invention to provide a means of simply and easily adjusting the height of the trusses on the job site.

It is an object of the present invention to provide a means of simply and easily adjust the height of the gutters on the job site.

It is an object of the present invention to provide roof trusses which can be easily divided in half to facilitate transportation.

It is an object of the present invention to provide trusses which can be quickly and easily attached to columns and which also provide a roof overhang.

It is an object of the present invention to provide a mounting system for the columns in a steel building that provides excellent strength against uplift loads.

It is an object of the present invention to provide a mounting system for the columns in steel buildings which reduces the time by as much as 90 percent and reduces the cost of construction by an average of thirty percent.

It is an object of the present invention to provide a foundation for a building that is resistant to cracking during construction.

The present invention provides a framing assembly system for steel building that substantially reduces the assembly time while maintaining excellent strength and mechanical integrity. In fabricating this type of building, foundation assemblies are first precisely located in both the horizontal and vertical planes when placed in concrete footings. The foundation assemblies include their own low vertical columns. Once the concrete has set, the main building columns are put in place over the low columns and bolted into place using pre-drilled and aligned holes that pass through the main building columns and the low foundation assembly columns, thereby eliminating the difficult task of holding the columns erect while trying to precisely locate the main columns in both the horizontal and vertical planes. Trusses are also connected to the top of the main columns by means of bolts passes through pre-drilled holes. A series of holes centered in a straight vertical line at regular intervals enables the assemblers to adjust the height of the trusses by selecting an appropriate set of holes through which to pass the bolts, thereby permitting the assembler to provide a desired roof pitch.

The gutters are supported by a short support arms which are placed into the hollow top of a structural adjustment sleeve that rest on the main columns. The gutter's height may be adjusted by means of bolts passed through any one of a plurality of pre-drilled holes that pass through the structural adjustment sleeve and the gutter support arm.

The trusses are divided in two at their middle to facilitate transportation. The truss halves are reconnected at the building site by bolting their lower chords together with the aid of a long square steel insert placed into the lower chords at the mid-section of the full truss. The top of the truss halves are connected together by means of bolting them to a steel tie plate.

To provide a secure anchoring of the main columns to the concrete footer, a "chair", formed of reinforcing bars, is accurately and securely positioned in the building footer. A leveling plate connected to a collar is attached to the top of the chair by way of "U" bolts at a precise location. The "U" bolts permit the collar to be easily moved to a precise location. The chair and plate are adjusted in height and in the horizontal plane with a laser measuring system. The collar is locked in place prior to the concrete's being poured about the chair by tightening the "U" bolts.

Once the concrete has set up, the collar is held permanently in its precise location, greatly facilitates rapid assembly and reduced assembly cost of the building.

To improve the strength of the collars against uplift loads, the chair of each column is attached by reinforcement bars to the chair of the next column, making it impossible to pull a single collar upward and out of the footer, without pulling the entire footer upward. The result of this construction technique is a vastly improved uplift load capacity for the structure.

One aspect of the invention features an anchor structure for use in building construction comprising a plurality of steel-reinforcing bars arranged and attached to each other in a framework, the framework comprising a top and a bottom and the bottom configured and adapted for securing the framework into the ground. The anchor structure also comprises a column attachment member having a base portion and a column receiving portion, with the base portion configured and adapted for attachment to the top of the framework and the column receiving portion configured and adapted for attachment to a column. The framework and at least a part of the column attachment member are encased in concrete.

In another aspect of the anchor structure, the framework may further comprise a plurality of primary members having ends and a U-shaped middle section with the middle section being orthogonal to the ends, and a plurality of secondary members connecting the plurality of primary members to each other. The ends of at least one of the primary members are configured and adapted to be inserted into the ground to secure the framework into the ground, and the middle sections of the primary members define the top of the framework onto which the column attachment member can be placed and secured.

In another aspect of the anchor structure, the column attachment member comprises a leveling plate between the base portion and the column receiving portion.

In another aspect of the anchor structure, the column receiving portion of the column attachment member comprises a stanchion over which a column may be placed.

In another aspect of the anchor structure, the column receiving portion of the column attachment member comprises a collar into which a column may be inserted.

In another aspect of the anchor structure, at least one of the primary members further comprises an interference member. The interference member is configured and adapted to engage the base portion of the column attachment member to prevent accidental movement of the column attachment member before the column attachment member is secured to the top of the framework.

Another aspect of the invention features a foundation structure for use in building construction comprising a concrete foundation with a plurality of anchor structures within the concrete foundation. Each anchor structure comprises a plurality of steelreinforcing bars arranged and attached to each other in a framework, with the framework having a top and a bottom, the bottom configured and adapted for securing the framework into the ground; and a column attachment member, having a base portion and a column receiving portion. The base portion configured and adapted for attachment to the top of the framework and the column receiving portion configured and adapted for attachment to a column; and steel reinforcing bars connecting each of the plurality of anchor structures to one another. The plurality of anchor structures are positioned in relation to each other before concrete is poured to form the concrete foundation.

Another aspect of the invention features a method of forming a foundation structure for use in building construction, comprising the steps of (a) preparing an area of ground, (b) positioning a plurality of frameworks in the area, with each of the plurality of frameworks comprising a plurality of steel-reinforcing bars arranged and attached to each other and having a top and a bottom, the bottom configured and adapted for securing the framework into the ground, (c) tying at least one of the plurality of frameworks to another of the frameworks using steel reinforcing bars, (d) positioning and securing a plurality of column attachment members to the anchor structures, with each of the column attachment members having a base portion and a column receiving portion, the base portion configured and adapted for attachment to the top of the framework, and the column receiving portion configured and adapted for attachment to a column; and (e) pouring concrete into the prepared area so as to cover the anchor structures and at least a portion of the column attachment members.

In another aspect of the method, the plurality of anchor structures are arranged and secured into the earth within the perimeter of the foundation structure.

In another aspect of the method, the plurality of column attachment members are positioned using a laser interferometer to ensure precise location before being secured to the plurality of frameworks.

Another aspect of the invention features a method of assembling a steel frame building, comprising (a) preparing an area of ground, (b) positioning a plurality of frameworks in the area, each of the plurality of frameworks including a plurality of steel-reinforcing bars arranged and attached to each other and having a top and a bottom, the bottom configured and adapted for securing the framework into the ground; tying at least one of the plurality of frameworks to another of the frameworks using steel reinforcing bars, (c) positioning and securing a plurality of column attachment members to the anchor structures, each of the column attachment members having a base portion and a column receiving portion, the base portion configured and adapted for attachment to the top of the framework, and the column receiving portion configured and adapted for attachment to a column, (d) pouring concrete into the prepared area so as to cover the anchor structures and at least a portion of the column attachment members, (e) attaching columns to the column receiving portions of the column attachment members, (f) attaching wall panels to the columns, (g) connecting the tops of the columns to form a header, and (h) attaching trusses to the header.

In another aspect of the method, the method further comprises the steps of: attaching roof panels to the trusses to form a roof and spraying insulation within the interior of the roof.

Another aspect of the invention features a method of forming a foundation structure used in building assembly, comprising the steps of (a) preparing an area of ground (b) positioning support structures in the prepared area and securing the support structures to the prepared area, (c) pouring concrete into the prepared earth such that at least part of the support structures project above the concrete, and (d) building the framework of the building on top of the support structures prior to the concrete curing such that at least a portion of the weight from the framework is transmitted through the support structures into the ground, thereby reducing the amount of weight borne by the concrete as it cures, and reducing the incidences of foundation cracking.

In another aspect of the method, the support structures further comprise a plurality of steel-reinforcing bars arranged and attached to each other in a framework, with the framework comprising a top and a bottom and the bottom configured and adapted for securing the framework into the ground. The support structure also comprises a column attachment member having a base portion and a column receiving portion, the base portion configured and adapted for attachment to the top of the framework and the column receiving portion configured and adapted for attachment to a column. The framework and at least a part of the column attachment member are encased in concrete.

DETAILED DESCRIPTION OF THE INVENTION

FIG. 1 is an exploded view showing a main column 5 used in the assembly of a steel building along with a gutter 2, a truss assembly 4 and a foundation assembly 6. Only a portion of the truss is shown in this Figure. This portion is made up of a left truss connection plate 4C, a lower chord 4A, a top member of the truss 4B, and an attachment plate 4C. At the top of this drawing is an adjustable rain gutter 2 with a support arm 2A, which contains a series of evenly spaced holes 2B. Directly beneath the support arm 2A, is a structural adjustment sleeve 3 which includes a line of vertically positioned evenly spaced holes 3A.

Directly beneath the structural adjustment sleeve 3 is the column 5, which contains holes at its top 5A and holes at its bottom 5B. Directly beneath the column 5 is the foundation assembly 6, which includes a low column 6D, a series of vertical holes 6A in the low column 6D, a horizontal plate 6B which is attached approximately midway up from the bottom of the low column and stabilizing tubes 6C which extend horizontally and are attached to the bottom of the low column.

Figure 2:
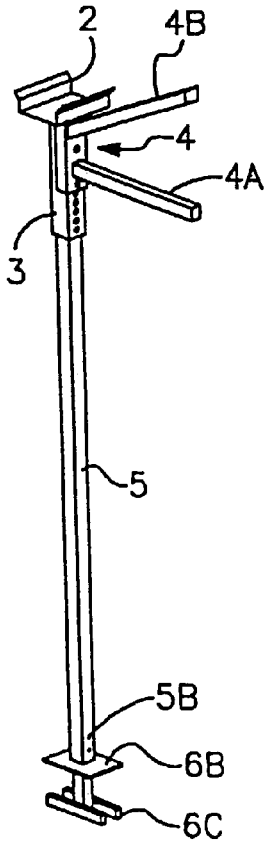
FIG. 2 shows all the components of FIG. 1 in their assembled positions.

The column assembly is shown completely assembled in FIG. 2. In this Figure, the support arm 2A for the gutter 2 is placed into the top of the structural adjustment sleeve 3. The bottom end of the structural adjustment sleeve is placed over the column 5. The truss connection plate 4C is U-shaped and wraps around to enclose a portion of the structural adjustment sleeve. The column 5 is hollow and is placed over the low column of the foundation assembly 6.

A major advantage of the assembly shown in FIGS. 1 and 2 is that all the components are bolted together. There is no need to weld any component, facilitating assembly on the job site. In addition, where height adjustment is required, it is provided by series of vertical holes. For example, the truss assembly can be moved up or down along the structural adjustment sleeve to a desired height and then locked at that height by placing a bolt through the truss connection plate 4C into one of the holes in the structural adjustment sleeve 3 that is at a desired level. A similar assembly and adjustment is carried out for the gutter. The gutter arm which supports the gutter contains a series of vertical holes 2B, which can be aligned with the holes 3A in the structural adjustment sleeve. The gutter is moved up or down to a desired location and a bolt is placed through the structural adjustment sleeve holes and the holes in the support arm for the gutter to lock the gutter in a desired location.

The foundation assembly 6 is set in concrete before any assembly begins. The plate 6B, which extends out horizontally from the low column portion of the foundation assembly lies on the top of the concrete and sets the depth to which the foundation assembly is placed in the concrete. It is accurately positioned in the vertical plane to set the elevation of the main column which will rest on this plate. Of equal importance is the fact that this plate is set to lie in the horizontal plane which insures that the orthogonally positioned low column is perfectly vertical and will support the main column in a perfectly vertical position. The foundation assembly is precisely located with respect to the various other main columns so that when a main column is placed over a low column of the foundation assembly, it is accurately located, enabling the components of the building to be assembled without cutting or drilling on site.

The precise location of the foundation assemblies is typically carried out with a laser interferometer which is vastly more accurate than the usual steel tape measure method used at most prior art construction sites. In addition, a laser surface of all the foundation plates are at precisely allowance as small as +/−0.001 inch. The present invention insures that the columns are precisely located in the both the horizontal and vertical planes, which means that they are at the correct elevation and are plumb and square.

The stabilizing tubes, which are connected to the bottom of the foundation assembles, are horizontally positioned rods. They anchor the foundation assemblies to the concrete footing and aid in preventing the foundation assemblies from being pulled from the concrete by lift loads. A second anchoring system, which employs a "chair" to provide even greater uplift load capacity, is describes later in this section.

The short column 6D of the foundation assembly is typically rectangular main column. Where the main column is hollow smaller in cross sectional than the main column main column. Where the main column is solid, a collar is substituted for the low column. The collar grips the main column from the outside, making it possible to use solid or closed ended columns for this type of construction.

In the assembly of the trusses and hollow columns, each column is placed over the foundation assembly and locked into place by placing bolts through holes 5B in the main column and 6A in the low column portion of the foundation assembly. This method of positioning the foundation assembly and the method of connection between the column and the foundation assembly provide a substantial advantage in assembly over the prior art. This method is simple and fast, while at the same time insuring the accurate location and positioning of the columns in both the horizontal and vertical planes. This is not the case in prior art systems. In prior art systems, the mounting system for the columns is simply bolts which are placed in the concrete. The location of the bolts is usually not precise and the concrete footing is not perfectly level, making it necessary to cut or redrill the flange at the base of the column used to connect to the column to the bolts. It is also necessary to place shims under the column in an attempt to position it vertically and at the correct elevation. These operations are difficult because they are often carried out while the column is suspended from a crane. If the column is simply bolted in, any errors in location of the column usually result in the need for cutting and fitting other building members which do not fit properly because of the column position error.

Figure 3:
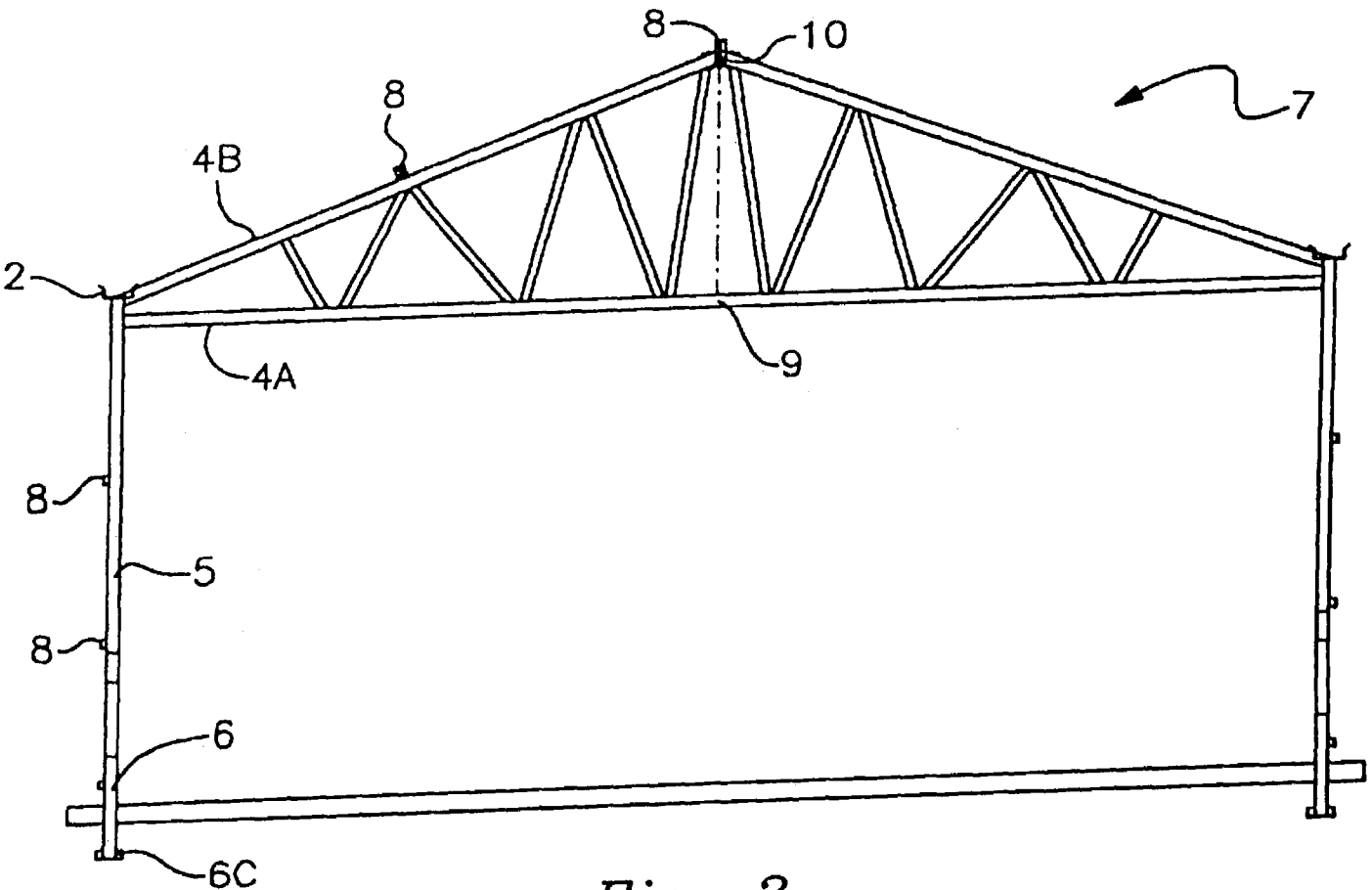
FIG. 3 is a cross section of a steel building using the columns shown in FIGS. 1 and 2 to support a roof truss.

FIG. 3 shows a cross section of a steel building using the columns and trusses of the present invention. The roof truss is supported on two column, with one column being located on each end of the truss. Each column is supported by its own foundation assembly. There is a dashed line 9 which divides the trusses in the middle. This is the line on which the trusses are separated for transportation. The ability to separate the truss into two halves substantially reduces the overall length which must be transported.

Figure 4:
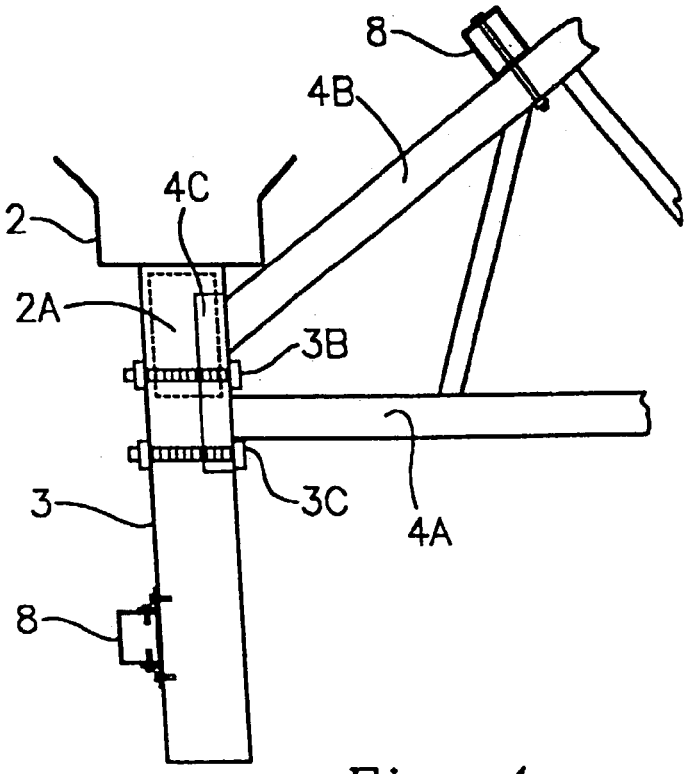
FIG. 4 is a detailed drawing of the connection of a truss to the column of FIG. 2.

FIG. 4 is a detailed drawing of the connection of the truss to the column. The structural adjustment sleeve is cut away at the top to reveal the position of the gutter support arm 2A within the column. The truss connection plate 4C is shown to partially wrap around the structural adjustment sleeve. Bolt and nut assemblies 3B and 3C pass through the truss connection plate and the structural adjustment sleeve to secure the truss to the column assembly. Purlins 8 are attached to the roof truss on its upper member 4B and also to the side of the column. The purlins 8 are used to tie one set of columns and trusses to the next. They run lengthwise along the building and are attached on the top of the roof and along the sides to tie the building elements together.

Figure 5:
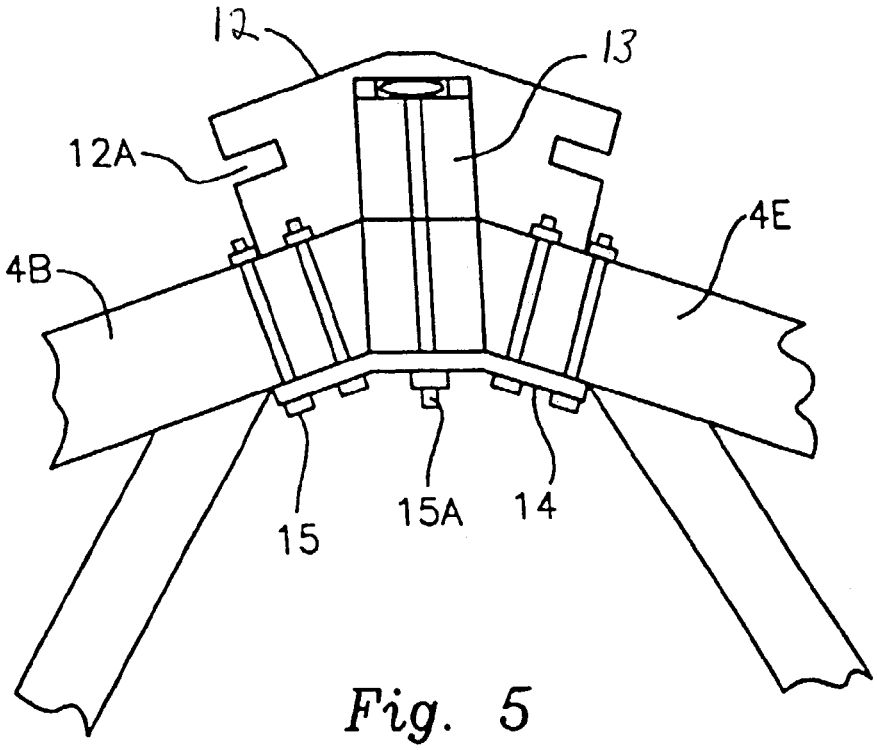
FIG. 5 is a detailed drawing illustrating the method of connection of the upper members of the two halves of a truss that is used in the construction of a building in accordance with the present invention.

FIG. 5 is a detailed drawing illustrated the method of connection of the two halves of the truss. This connection in this Figure is made at the top center of the truss, where each half is joined. The main connection element is the steel tie plate 14, which lies on the under side of the upper member of both halves of the truss, 4B on the left and 4E on the right. This plate is bolted to the upper members of the truss as shown by galvanized hexagonal bolts, such as by bolt 15, which passes through the plate and through the members 4B and 4E. At the peak of the truss, a square galvanized steel purlin 13 is attached by a bolt 15A which goes through the trusses and into the connection plate. Above this purlin is mounted an extruded aluminum ridge cap 12, which covers the purlin, but allows air into and out of the building without accepting rain water into the building. The air enters through a side vent 12A in this extrusion.

Figure 6:
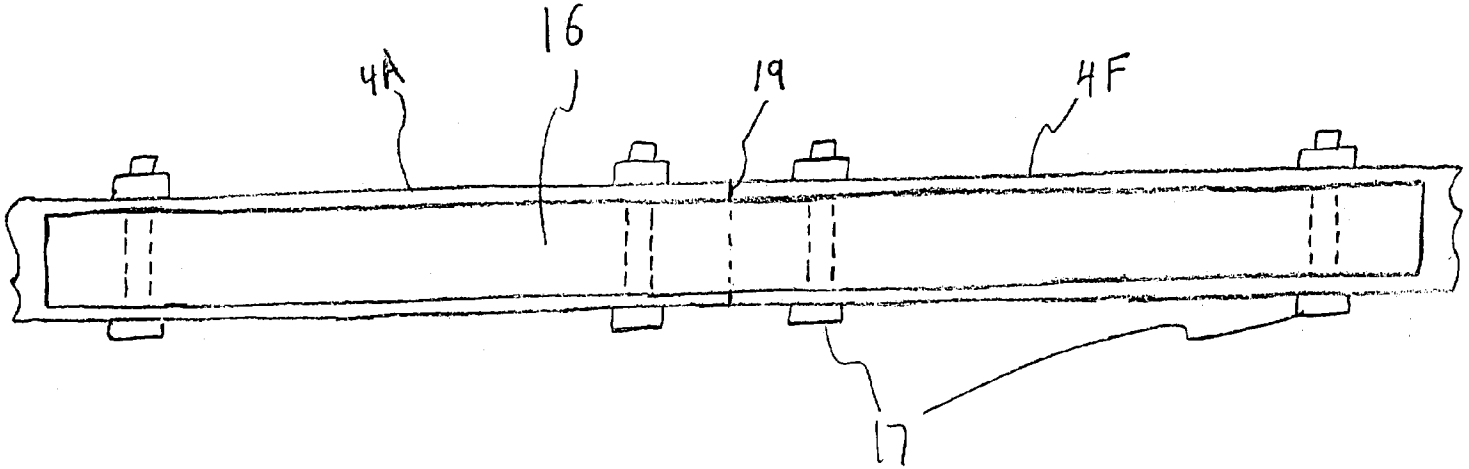
FIG. 6 is a detailed drawing illustrating the method of connection of the two halves of a truss along its lower chord.

FIG. 6 is a detailed drawing illustrating the method of connection of the two halves of the truss along their lower chord. The lower chord of the trusses is U-shaped with the open portion of the U facing upward. The left hand lower chord is designated 4A, while the lower right hand chord is designated 4F. These chords are divided at line 19 on this drawing. Into the opened portion of the lower cord of the truss is inserted a square steel insert section 16. This insert section typically extends over several feet, often having a length of three feet or more. It is bolted to the truss in several places by bolt and nut sets, such as a set 17. It can be seen from FIGS. 5 and 6 that the two halves of the truss are easily connected by merely bolting them to the tie plate 14 and the insert 16.

Figure 8:
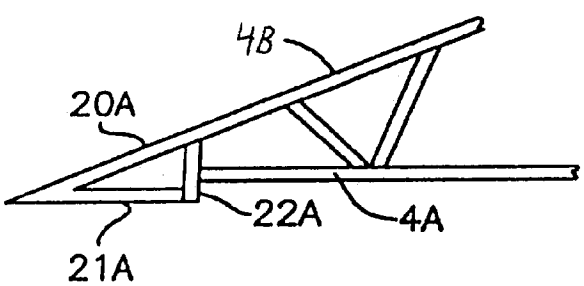
FIG. 8 is a second drawing of a portion of a second special truss with an extended end used to provide a building overhang.
Figure 7:
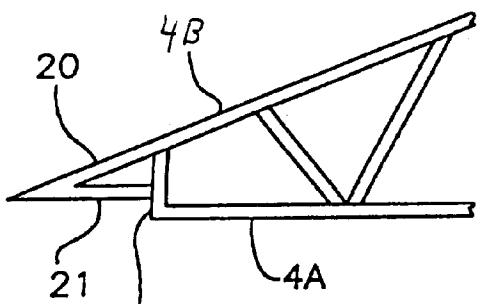
FIG. 7 is a first drawing of a portion of a special truss which includes an extended end used to provide a building overhang.

The truss shown in FIG. 3 has no overhang, making it primarily useful for industrial or farm buildings. However, the truss used in the construction of steel frame buildings described herein can be modified to include an overhang. Overhangs are included in the trusses shown in FIGS. 7 and 8. FIG. 7 is a first drawing of a portion of truss with an extended end used to provide a building overhang, while FIG. 8 is a second drawing of a portion of the truss showing a different extended end to provide a building overhang. In FIG. 7, upper member 4B is extended to the left with a section of steel beam 20. A return beam 21 is located below beam 20 to produce a step in the beam at location 22 which rest on the structural adjustment sleeve. Members 20 and 21 extend out to the left to provide an overhang. In this configuration the truss drops down at the step 21 below the top of the structural adjustment sleeve on the inside of the building.

In FIG. 8 the truss drops down below the structural adjustment sleeve on the outside of the building. This latter truss is extended by a top member 20A and a bottom member 21A. Either configuration can be used to advantage to produce the overhang typically found in home structures.

Figure 12:
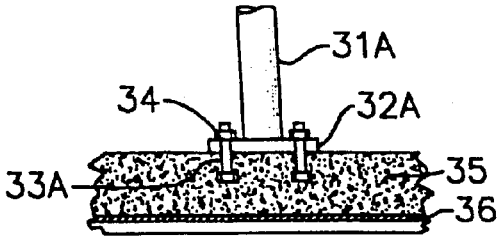
Fig. 12 Prior Art
FIG. 12 is a cross sectioned view of a prior art concrete footer and mounting assembly for a steel column.

FIG. 12 is a cross sectional view of a prior art concrete footer 35 with a reinforcing bar 36, and mounting assembly for a steel column 32B. Note that in this prior art system, the mounting assembly is not connected to the reinforcing bar. The mounting assembly consists of a flange 32A connected to the bottom of the column and straight bolts such as bolt 33B, which pass through the flange and are secured to the flange with nuts, such as nut 34B. The bottom of the bolts are placed in the concrete footer before it sets. Nothing holds these bolts other than the concrete. An uplift load on one column sufficient to lift out these bolts will detach the column from the footer. In the present invention the columns are secured to the steel in the footer providing a much improved uplift load.

Figure 12A:
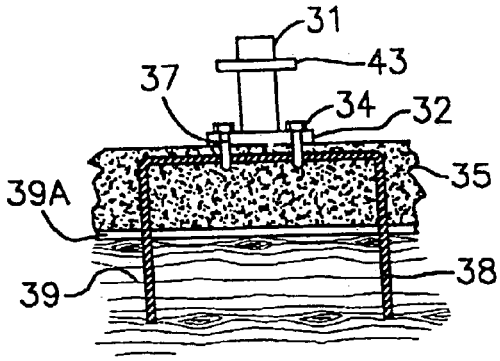
FIG. 12A is a cross sectional view of a concrete footer and mounting assembly for a steel column in accordance with the present invention. A chair, fabricated from reinforcing bars, which is shown in this Figure, is used to aid in supporting and accurately positioning a collar used to hold a steel column.
Figure 12B:
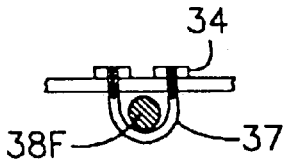
FIG. 12B shows a side view of a U-bolt used to connect a leveling plate to a chair.

FIG. 12A is a cross sectional view of a concrete footer 5 and a mounting assembly for a steel column, which consists of a collar 31, a pin 43 passing through the collar, a plurality of U-bolts, such as U-bolt 37, nuts on the U-bolts, such as nut 34, a mounting plate 32 and beneath the plate a framework of reinforcing bars 38, referred to as a chair.

Figure 13:
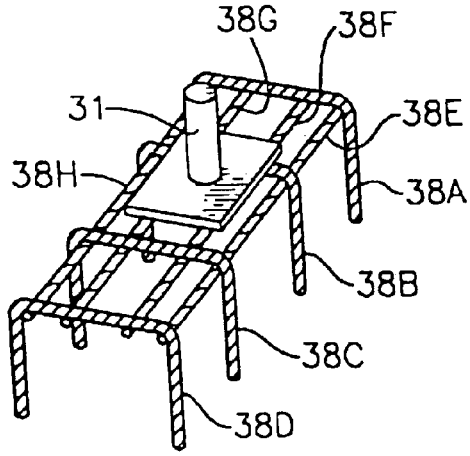
FIG. 13 is a perspective of a chair showing the typical location of reinforcement bars used to construct the chair and the position of a leveling plate and collar on the chair.

A typical framework for a chair is shown in FIG. 13. It consists of a series of bars, such as bars 38A, through 38D; all of which are inverted U-shaped bars with their lower ends being pressed into the earth 39 below the footers bottom level 39A. These bars are placed into the footer cavity before the footer is poured. The chair also includes straight rods 38E through 38H which run orthogonally across the top of the U-shaped bars 38A through 38D. These straight bars are attached to the U-shaped bars by wires which are twisted about the bars where they contact one another.

The bottom of the U-bars in the chair are pounded into the earth 39 in the area where the footer is to be poured. A mounting plate 32 with a collar 31 attached is secured to the straight bars by a series of U-bolts, such as bolt 37 shown in FIGS. 2A and 2B. This plate allow movement of the collar along the bars to a selected position where the U-bolts can be tightened to hold the collar in place. The pounding of the chair into the ground secures its position and prevents the unintended movement of the collar. The level of the collar is set by pounding the chair up or down. The course position of the collar in the horizontal plane is adjusted by loosening the wires holding the straight bars to the U-shaped bars and by moving the position of the straight bars. The collar is moved for fine positioning by leaving the U-bolts loose. The collar is easily moved at this stage because it does not have the weight of the column on it.

As noted above, a laser interferometer is typically used to set the location of the collar to an accuracy of one thousandth of an inch, rather than one fourth or one half of an inch. The footer is then poured, locking the collar at a precise location. The column is then dropped into the collar and the columns position is accurately determined by the collar.

Each collar is attached to a chair and each chair is attached to the next adjacent chair so that each collar is attached to the steel reinforcement running through out the length of the footer, unlike prior art systems where the column mounting bolts were not attached to the reinforcing rods. The result of the use of the chairs and their interconnection is a greatly improved uplift load strength.

Figure 10:
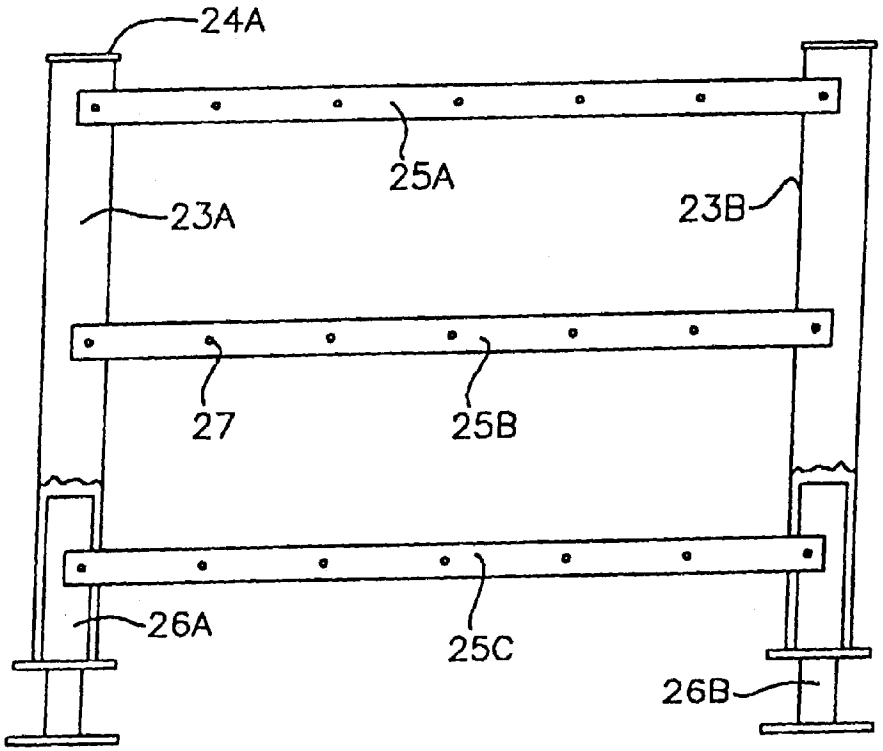
FIG. 10 is a rear view of the fence of FIG. 9.
Figure 9:
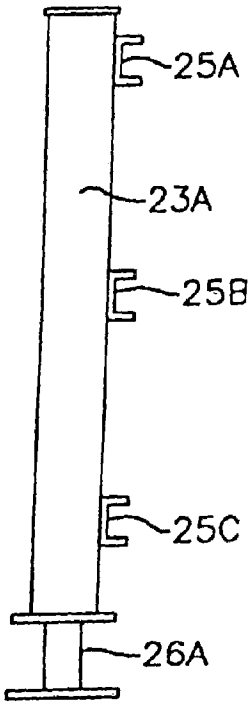
FIG. 9 is a side view of the post portion of a stockade fence fabricated in accordance with the present invention.

The techniques described above for mounting columns are not limited to building construction, but can be applied to fence construction as illustrated in FIGS. 9 and 10. FIG. 9 is a side view of a portion of stockade fence, fabricated in accordance with the present invention. FIG. 10 is a rear view of the same fence as shown in FIG. 9.

FIG. 9 shows a steel fence post 23A. Attached to the right side of the fence post in FIG. 9 are three "C" channels 25A, 25B, and 25C, all of which have their open face directed away from the post so that they can accept wooden cross member of a stockade fence. The "C" channels typically have inside dimensions of 1 inch in width by 3 inches in height. The separation between the channels is typically 25½ inches with the bottom channel usually being 8½ inches above ground level.

The post 23A is supported by a low column base 26A which is installed in the ground before the fence is erected. The column is usually secured in concrete. Then, the hollow steel post is placed down over the short column. A pin may he placed through the low column and post to lock the post to the column It can be seen in the rear view of FIG. 10 that two fence posts 23A and 23B are separated from each other. Typically this separation is 5 feet on centers. The channels 25A, B, and C extend across the post horizontally with one end of each channel being attached to one post, while opposite end is attached to the remaining post. The channels have predrilled holes, such as hole 27, which are typically placed 16 inches apart on centers. These holes are designed to accept screws which hold the fence cross members to the "C" channels.

The lower portion of the posts are shown as being broken away in FIG. 10 to illustrated the location of the low column 26A and 26B which are installed within the fence posts 23A and 23B. In erecting the fence, the low columns are set in the ground and are usually held in place with concrete. Their short height makes working with the columns much easier than trying to set 6 foot post in concrete, while at the same time holding the posts erect. It is obviously much easier to set the low columns a precise distance apart and maintain that distance as well as maintain them in a vertical position while the concrete sets. Once the columns have been set, the post are merely placed over the columns, and pinned in place. The "C" channels are attached and a section of stockade fence is attached by screwing the cross members to the "C" channels.

Replacement is also made easier by this system. The posts are not set in concrete and can be removed merely by removing the pins. New posts are installed by simply slipping them over the columns. A section of stockade fence is replaced by unscrewing the old section from the "C" channels and replacing it with a new one. The placement of the columns in concrete, the pinning of the posts to the columns and the reinforcing of stockade fence with steel "C"

channels greatly strengthens the fence, enabling it to withstand horizontal wind loads as well as uplift forces.

Figure 11:
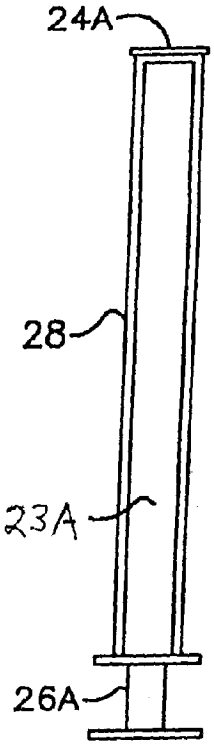
FIG. 11 is a side view of a plastic fence post, such as a PVC or vinyl post covering a steel post.

FIG. 11 shows a steel post 23A supporting a plastic post 28. The steel post is supported by a short column base 26A as described above. Over the steel is placed a plastic post such as a PVC or Vinyl post which is covered at its upper end with a cap 24A.

The steel post supports the plastic post and since it used the low column support 26A, it has all the advantages of the above described system. Plastic fence systems are currently available that are designed to have cross members attached to plastic posts to produce a fence. By placing the steel post inside the plastic post, all the advantages of the present invention are easily added to readily available plastic fence systems.

Figure 15:
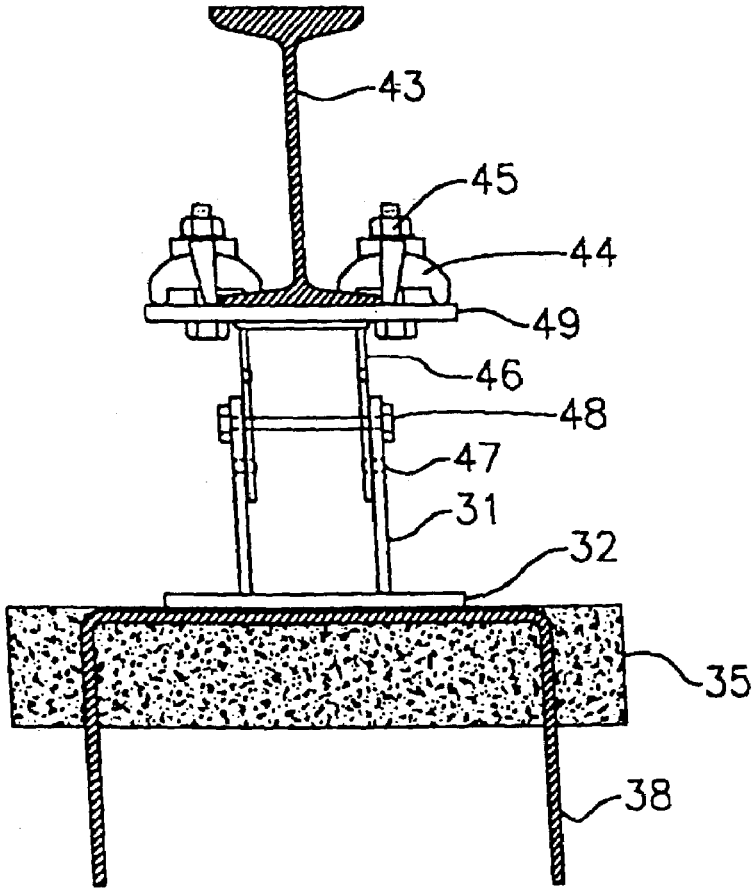
FIG. 15 is a cross sectional view of a chair-type anchor system for mobile homes.

The strength of the chair and the linked steel along the footing give the chair and the short column or collar attached to the chair great strength against hurricane up-lift loads. This strength can be used to secure mobile homes and trailers against hurricane force winds. The use of the chair for anchoring mobile homes is shown in FIG. 15. In this Figure, the collar 31 is connected at its lower ends to the mounting plate 32 which is connected to chair 38. Its upper end contains a series of holes, such as hole 47 which permit a bolt 48 to be passed through the collar.

Located above and fitting within the collar is a collar adapter 46. This adapter includes an anchor plate 49 at its top and holes through its side to permit the bolt 48 to pass through the adapter and the collar and lock these two elements together. The adapter can be adjusted in height above the ground by selecting a particular one of the set of holes in the collar to pass the bolt. This allows the adapter to be brought to the height necessary to connect the adapter plate to the I-beam 43 on which a mobile home is constructed. There are typically two such I-beams; however, only one is shown in the drawing. An identical anchoring system is used for the second I-beam. The connection to the I-beams is made using I-beam adapter clamps such as clamp 44 which rest on both the anchor plate 49 and the I-beam as shown in FIG. 15. The I-beam adapter clamps are held in place and tightened to hold the I-beams to the anchor plate by means of a bolt and nut set such as set 45.

Figure 14A:
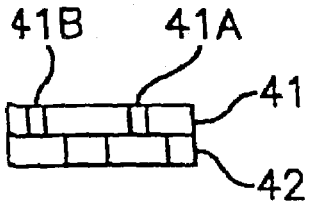
FIG. 14A is a cross sectional view of a top and bottom adjustment plate which are used to facilitate precisely locating the collar.
Figure 14B:
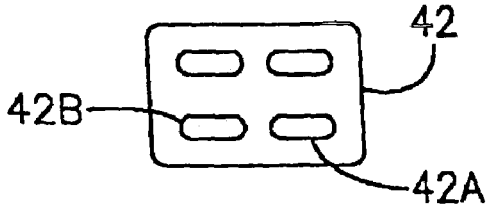
FIG. 14B is a plan view of the bottom adjustment plate of FIG. 4A.

Upon the disclosure of the above mounting and frame construction system to those skilled in the art, many variations will become apparent, all of which are considered as being within the spirit and scope of the present invention. For example, rather than a low column or a collar which grips the outside of the column, a bracket can be substituted which attaches to the side of the column. Rather than loosening wires in a chair or U bolts to adjust the position of a collar or low column, two plates such as plates 41 and 42 with holes 41A and 41B and slots 42A and 42B respectively, as shown in FIGS. 14A and 14B, can be used with bolts passing through the holes and slots to connect the plates to the collar and chair and to permit the collar to be moved into position using the slots for movement. The collar is clamped into place by tightening the bolts.

Figure 16:
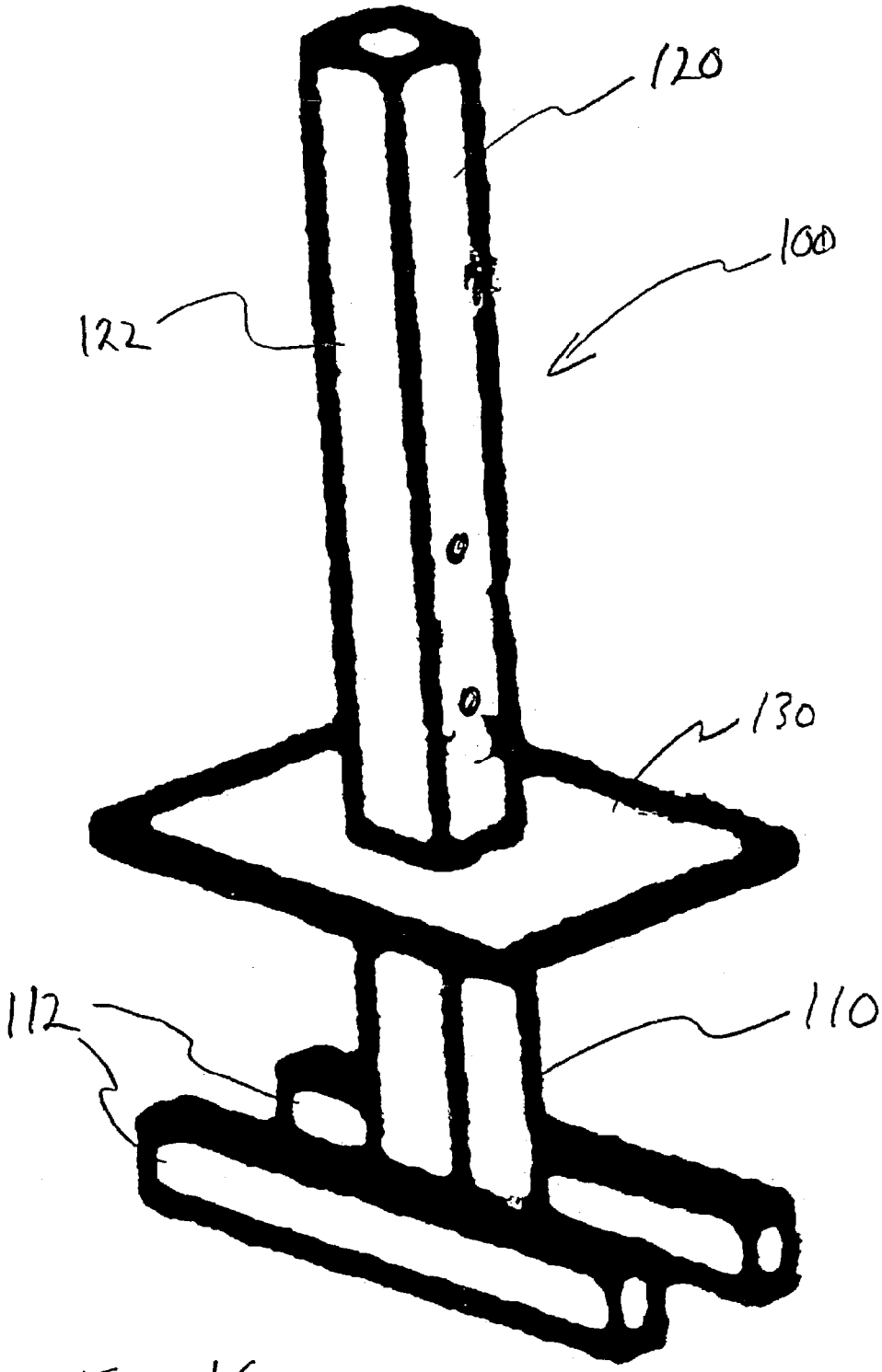
FIG. 16 is a side view of an anchor structure in accordance with the present invention comprising a column attachment member (the "base") and a framework of steel reinforcing bars (the "chair").

The foundation assembly 6 shown in FIG. 1 may also be characterized as a column attachment member, or "base" 100 as shown in FIG. 16, comprising a base portion 110 and a column receiving portion 120. The column receiving portion 120 may comprise a stanchion 122. In another preferred embodiment, the column receiving portion may comprise a collar. The base portion 110 may comprise support tubes 112, allowing the base 100 to rest upon a horizontal surface. Base 100 may also comprise leveling plate 130 between base portion 110 and column receiving portion 120.

Figure 17:
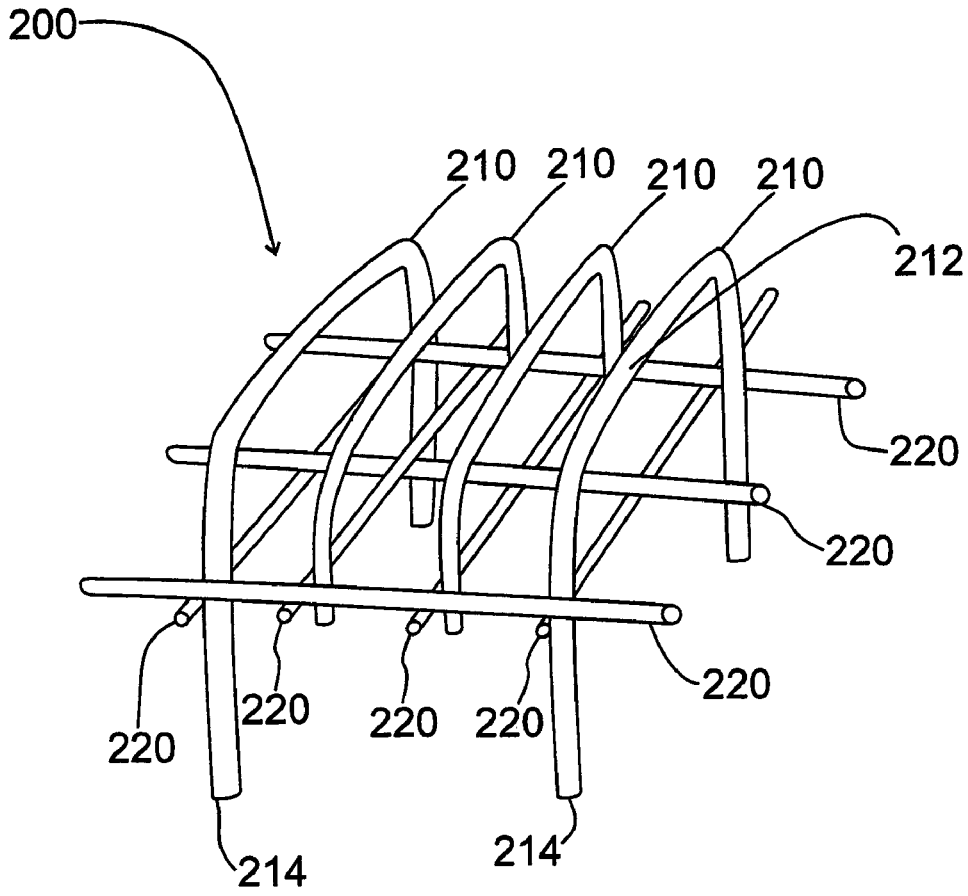
FIG. 17 is an perspective view of a chair in accordance with the present invention.
Figure 18:
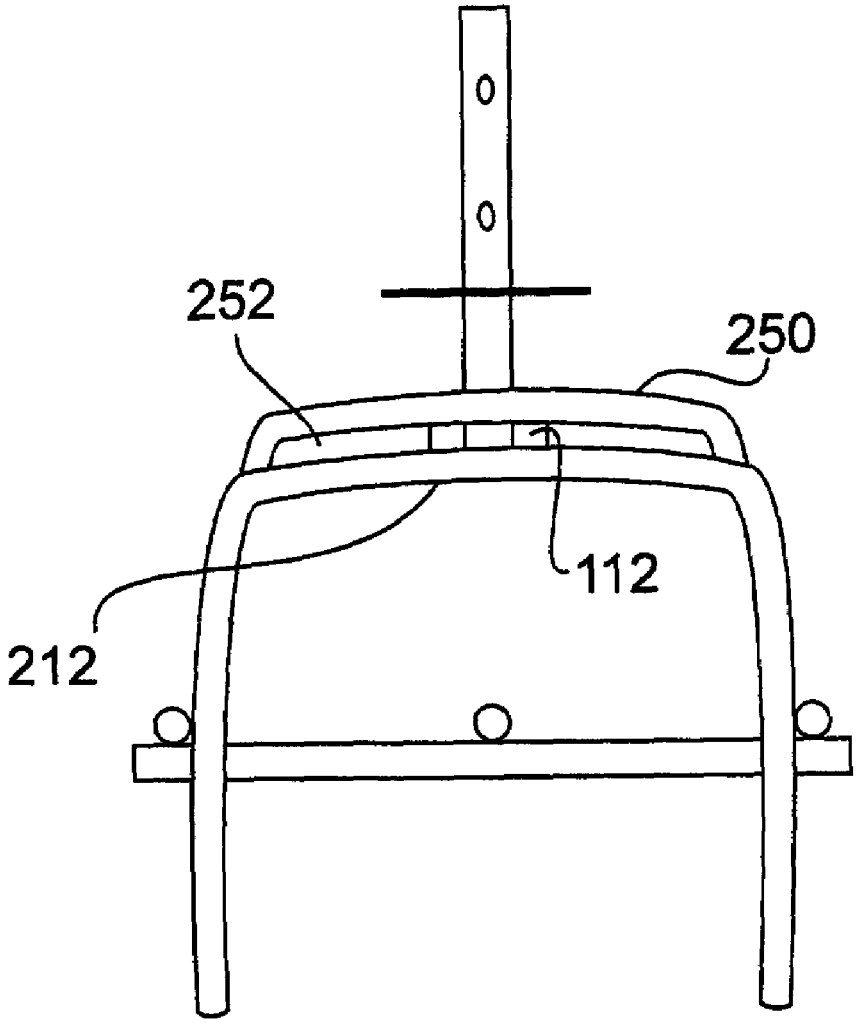
FIG. 18 is a side view of another embodiment of the chair in accordance with the present invention.

In a preferred embodiment, shown in FIG. 17, the "chair" 200 comprises reinforcing bars 202 welded together. Primary members 210 are U-shaped bars connected to each other with connecting bars 220. Support bars 230 add additional stability to the chair 200. The horizontal portions 212 of the primary members 210 provide a horizontal surface 240 onto which the base 100 can be supported. At least some of the primary bars 210 have ends 214 that are configured to be inserted into the ground, In another preferred embodiment of the chair 200, shown in FIG. 18, at least some of the primary members 210 have an interference member 250, at least a portion of which is parallel to the horizontal portion 212 of the primary member 210, creating a space 252 into which support tubes 112 of a "base" can be inserted. Preferably, when support tubes 112 are inserted into space 250, there is a slight interference between support tubes 112 and the horizontal portion 212 and interference member 250. This allows the base 100 to be resistant to accidental movement while it is being positioned on top of the chair 200. However, base 100 is still movable, allowing base 100 to be positioned in a precise location before fixing base 100 to chair 200 by U-bolts or other similar fasteners. This further ensures that base 100 is precisely located atop chair 200 before concrete for the footer is poured. It also strengthens the attachment between base 100 and chair 200 to further counteract uplift forces experienced by the base 100.

Figure 19:
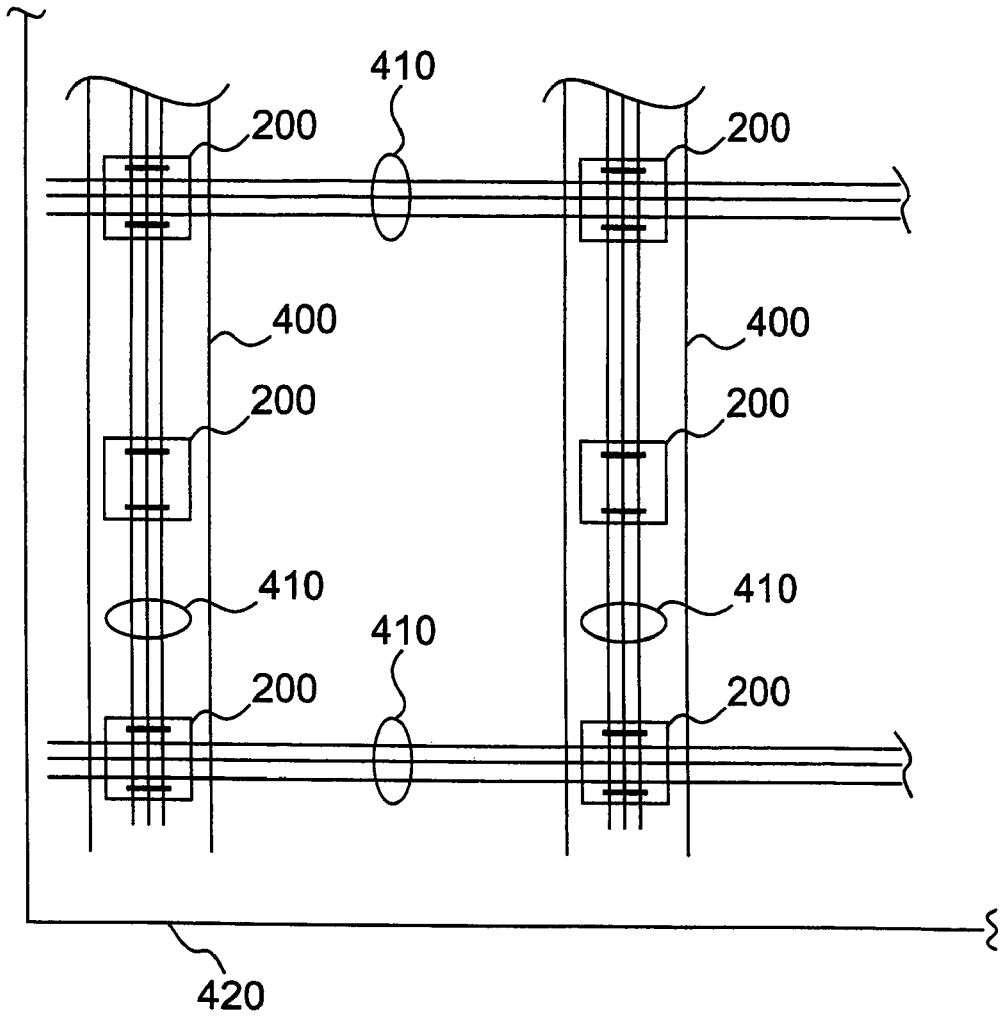
FIG. 19 is an top view of the foundation of a building constructed in accordance with the present invention.
Figure 20:
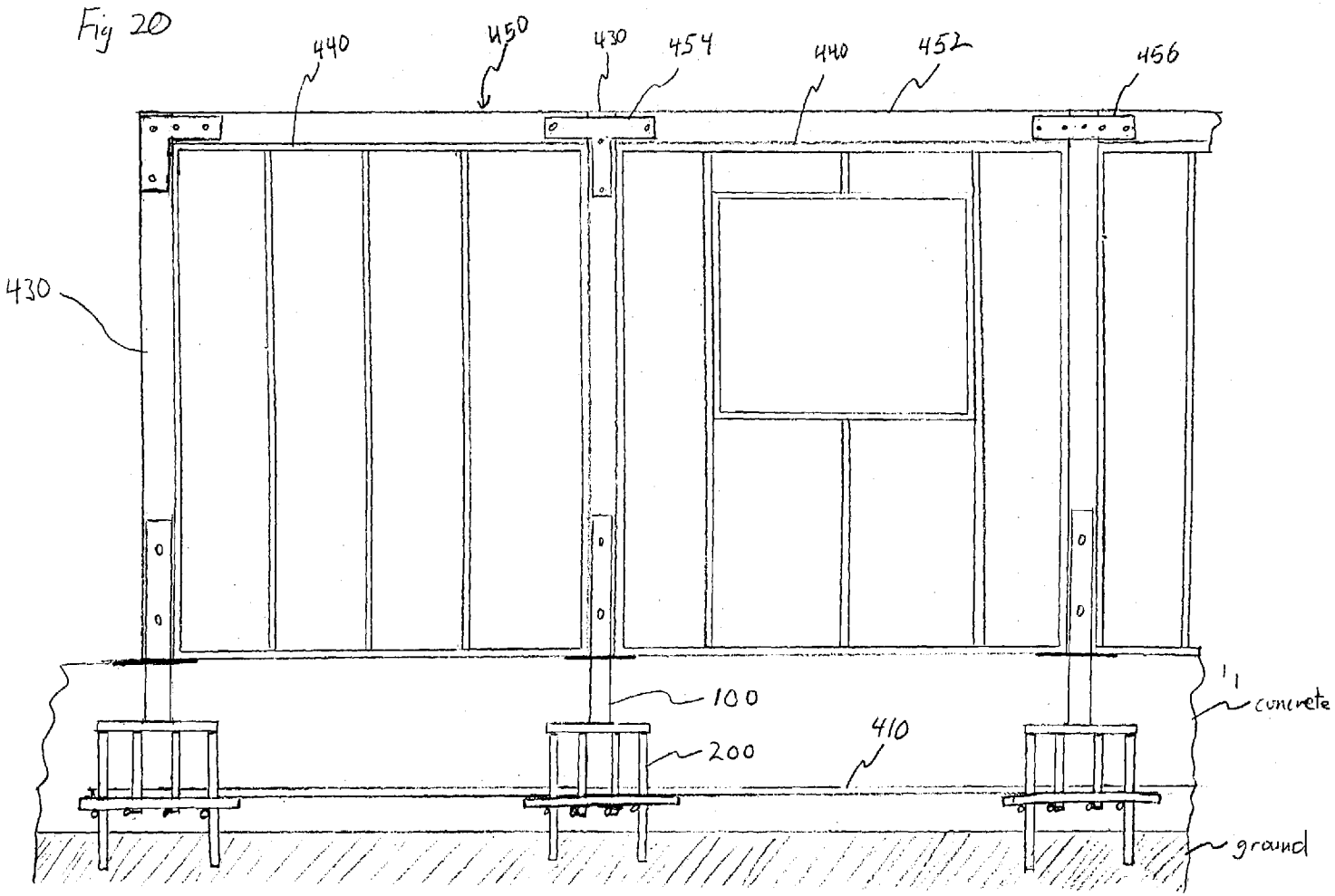
FIG. 20 is a side partial cross-sectional view of the framework of a building built in accordance with the present invention.
Figure 21:
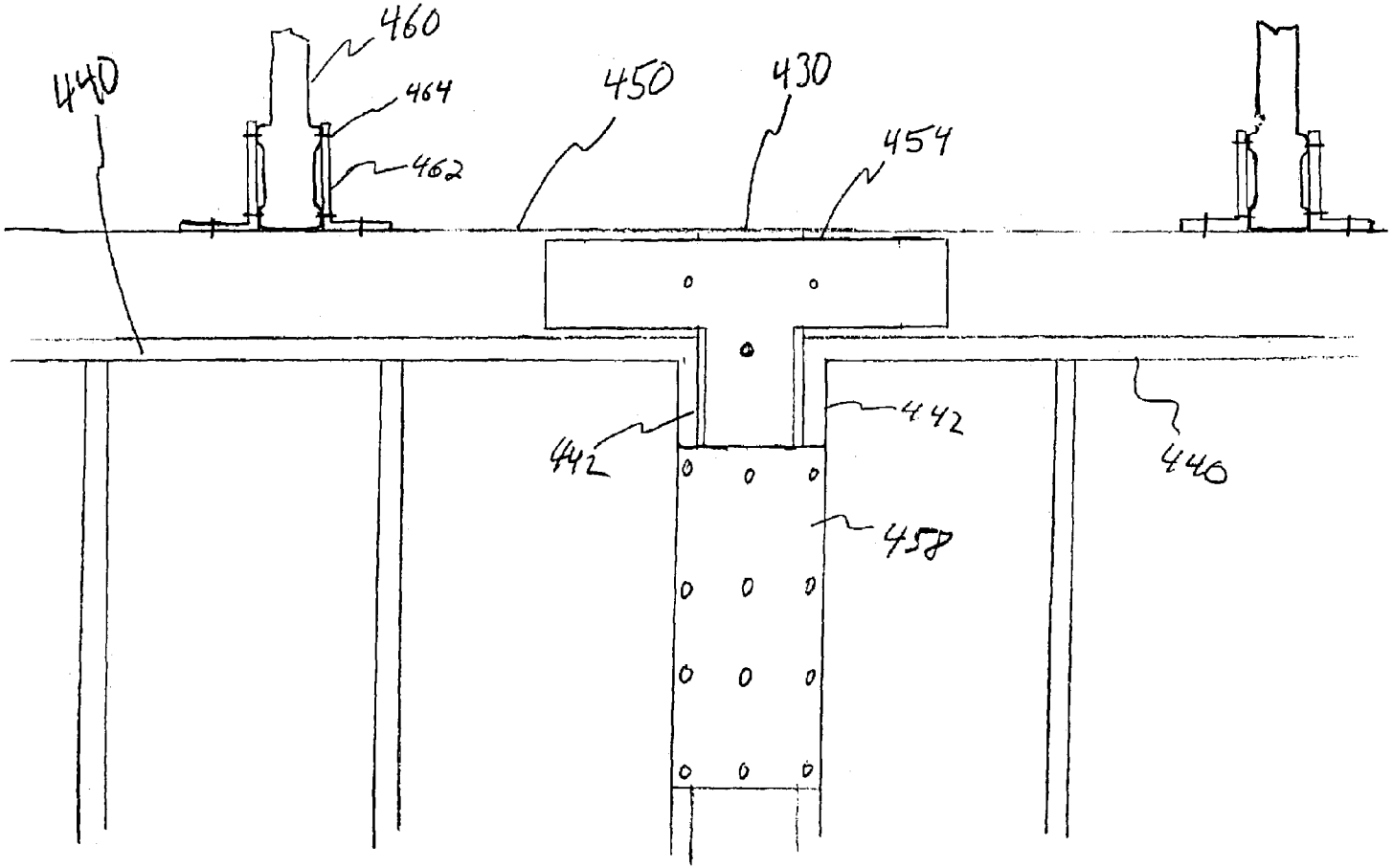
FIG. 21 is a side partial cross-sectional view of the attachment of the trusses to the header of a building framework built in accordance with the present invention.

The use of the "chair and base system" in combination with a concrete footer and steel framework members results in buildings being constructed at greatly reduced construction times and costs with greatly improved resistance to uplift loads. In a preferred method, described herein and in FIGS. 19–21, batter boards are placed to locate the foundation of the structure, which may comprise a footer, a slab, or both a footer and a slab. As shown in FIG. 19, trenches 400 are then dug out to receive form boards (not shown). When the form boards are installed, chairs 200 are placed in their proper locations, then pushed into the ground to set them into place at the desired height. The chairs 200 are then tied or attached together with reinforcing bars 410. The reinforcing bars 410 form a continuous connection around the perimeter of the area where concrete is to be poured for the foundation 420.

Bases 100 are then positioned atop and attached to each chair 200. Using a laser interferometer, each base 100 can be positioned precisely in relation to each other. Horizontal adjustment of base 100 is achieved by simply moving base 100 on chair 200 in the horizontal plane, while vertical adjustment of base 100 may be performed by adjusting the amount chair 200 is inserted into the ground. Once the exact position of each base 100 is set, it is attached to chair 200 using U-bolts or other similar fasteners. Using this method, the position of each and every base 100 is fixed in its precise and proper location before any concrete is poured. Concrete is then poured into trench 400 to form the footer. In a preferred embodiment, the same concrete pour is used to form the slab (i.e. a monolithic pour) so that the level of the concrete comes up to leveling plates 130 of bases 100. Because each base 100 is resting on a chair 200, and each chair is fixed into the ground, the bases 200 don't move during this process, allowing them to remain precisely located. The concrete is then allowed to set, thereby forming a concrete foundation with 1) stanchions 122 already precisely located in the positions where the columns for the building framework are to be attached, and 2) a continuous steel connection running throughout perimeter of the foundation which connects each chair 200, and therefore each column, to each other.

After the concrete is poured, columns 430 are attached to the column receiving portion 120 of each base 100. In a preferred embodiment, the columns 430 are 3 inch×3 inch square steel tubes, which are dropped over stanchions 122 of each base 100 and attached using ½ inch×5 inch carriage bolts. In a preferred embodiment, the 3 inch×3 inch columns also have a ¾ inch furring.

Wall panels 440 comprising a frame 444 and studs 442 are then placed in between and attached to columns 430. In a preferred embodiment, the wall panels are 18 gauge 2 inch×6 inch wall panels, which may be prefabricated off-site, and are attached with a ¾ inch offset, and using the ¾ inch furring of the columns 430 as a ground, by self-tapping screws.

The top of each column 430 is then linked to the tops of adjacent columns 430 to form a header 450, forming a continuous perimeter beam that connects all of the columns and wall portions together. In a preferred embodiment, 3 inch×3 inch square steel tubing 452 is used, and is attached to columns 430 by T-strap connectors 454, flat strap connectors 456, or other similar connectors. In a preferred embodiment, the height of the wall panels is slightly less than that of the columns, allowing the steel tubing 452 that forms the header to be attached to the sides of the columns 430. This allows the steel tubing 452 to be shorter in length, making them easier to handle. In a preferred embodiment, 18 gauge metal 458 may also be used to attach the studs 442 of adjacent wall panels 440 to each other and to the column 430.

Roof trusses 460 are then positioned and attached to header 450. While any type of suitable trusses may be used with the present invention, in a preferred embodiment, steel trusses manufactured by Steel-Con™ are used. In a preferred embodiment, angle clips 462 which have been designed to withstand extreme uplift forces are used to attach the trusses 460 to the header 450 by self-tapping steel screws 464 or other similar fasteners. Furthermore, because of the load distribution created by the spacing of the columns,, the trusses 460 can be spaced much further apart than in prior art systems, reducing the amount of trusses 460 needed. In a preferred embodiment, the trusses 460 are place 4 feet apart from center, compared to spacing the trusses 460 2 feet from center as commonly done in the prior art. Having wider spaces between the trusses 460 also makes subsequent procedures such as installing insulation, further described below, easier to accomplish. Roof panels may then be attached to the trusses 460 to form the roof of the building. In a preferred embodiment, 22 gauge roof panels are used, installed in a horizontal and staggered fashion.

The rest of the building may then be finished as desired by the builder. For example, in a preferred embodiment, an overhang for the roof is formed by inserting 1 inch×3 inch steel tubing into the open ends of the trusses 460, cut to the proper pitch and adjusted to the proper length to create the desired overhang, and then connecting them together around the perimeter of the roof using a steel sub-fascia. A fascia may then be applied. In a preferred embodiment, insulation is sprayed on the interior of the roof, as well as on the walls and floors of the building. In a preferred embodiment, the insulation is provided by Icynene™. This greatly improves the insulation qualities of the resulting building, reducing heating and cooling costs. Pressure treated lumber may be used to frame the window and door openings. The exterior of the building may be finished using stucco finishing or any other types of exterior finishing desired.

In addition to being highly resistant to uplift forces, it is believed that a building constructed using the present invention is also highly resistant to seismic effects, due to the integration of the framework members with each other and with the steel-reinforced concrete foundation. An additional benefit of constructing a concrete foundation using the present invention as described above is that there is less cracking of the concrete foundation as the construction of the building framework takes place. Because the framework of the house is connected to the columns, and the columns are supported by the bases, which in turn are supported by the chairs that are pressed into the ground underneath the concrete footer and/or slab, the weight of the structure is largely supported by the ground, as opposed to the concrete. This greatly reduces the amount of cracking as compared to the prior art, where the weight from building on concrete that has not been completely cured often resulted in cracking of the concrete foundation.

Although the overall assembly system disclosed herein may at first appear as merely another building technique, it has not been previously employed in the industry, despite its very considerable advantages, as described above. As an example of time saving provided by this system, a 1400 square foot building can literally be assembled in hours after the foundation has been set, as opposed to conventional construction which takes typically one to two weeks. The construction cost is reduced drastically as well. This allows the builder to construct a building at a reduced cost while being able to use higher quality materials for a given price range.

Furthermore, it is to be understood that, while the present invention has been described above mainly in the context of what is known in the art as curtain wall construction, the present invention can also be used in other types of construction, including the construction of high-rise buildings.

While certain preferred embodiments of the present invention have been described and explained, it will be appreciated that numerous modifications and other embodiments may be devised by those skilled in the art. Therefore, it will be understood that the appended claim are intended to cover all such modifications and embodiments which come within the spirit and scope of the present invention.

I claim:

1. An anchor structure for use in building construction comprising:

a plurality of steel-reinforcing bars arranged and attached to each other in a framework, said framework comprising a top and a bottom, said bottom configured and adapted for securing said framework into the ground; and a column attachment member having a base portion and a column receiving portion, said base portion configured and adapted for attachment to said top of said framework and said column receiving portion configured and adapted for attachment to a column;

wherein said framework and at least a part of said column attachment member are encased in concrete and wherein said framework further comprises:

a plurality of primary members having ends and a U-shaped middle section, said middle section being orthogonal to said ends; and a plurality of secondary members connecting said plurality of primary members to each other, wherein said ends of at least one of said primary members are configured and adapted to be inserted into the ground to secure said framework into the ground and said middle sections of said primary members define said top of said framework onto which said column attachment member can be placed and secured.

2. The anchor structure of claim 1 wherein said column receiving portion is a stanchion over which a column may be placed.

3. The anchor structure of claim 1, wherein said column receiving portion is a collar into which a column may be inserted.

4. A foundation structure for use in building construction, comprising:

a concrete foundation;

a plurality of anchor structures within said concrete foundation, each anchor structure comprising a plurality of steel-reinforcing bars arranged and attached to each other in a framework, said framework having a top and a bottom, said bottom configured and adapted for securing said framework into the ground; and a column attachment member, having a base portion and a column receiving portion, said base portion configured and adapted for attachment to said top of said framework and said column receiving portion configured and adapted for attachment to a column; and steel reinforcing bars connecting each of said plurality of anchor structures to one another;

wherein said plurality of anchor structures are positioned in relation to each other before concrete is poured to encase each framework and a lower portion of each column attachment member in concrete, to form said concrete foundation.

5. The anchor structure of claim 1, wherein at least one of said primary members further comprises an interference member, said interference member being configured and adapted to engage said base portion of said column attachment member to prevent accidental movement of said column attachment member before said column attachment member is secured to said top of said framework.

* * * * *